US010464194B2

(12) United States Patent
Su

(10) Patent No.: US 10,464,194 B2
(45) Date of Patent: Nov. 5, 2019

(54) HIGH STRENGTH DRIVE EXTENSION

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 189 days.

(21) Appl. No.: 15/629,880

(22) Filed: Jun. 22, 2017

(65) Prior Publication Data

US 2018/0178357 A1 Jun. 28, 2018

(30) Foreign Application Priority Data

Dec. 22, 2016 (CN) ..... 10 5 142715

(51) Int. Cl.
*B25B 21/00* (2006.01)
*B25B 23/00* (2006.01)

(52) U.S. Cl.
CPC ..... *B25B 23/0021* (2013.01); *B25B 23/0035* (2013.01); *B25B 21/00* (2013.01)

(58) Field of Classification Search
CPC .... B25G 1/043; B25G 1/005; B25B 23/0021; B25B 23/0035; B25B 13/481; B25B 21/00
See application file for complete search history.

(56) References Cited

U.S. PATENT DOCUMENTS 5,333,523 A * 8/1994 Palm ..... B25B 23/00 403/325
8,146,461 B1 * 4/2012 Su ..... B25B 23/0035 403/322.1
8,424,423 B2 * 4/2013 Su ..... B25B 15/001 403/322.2
8,651,764 B2 * 2/2014 Lin ..... B25B 23/0021 403/322.2
9,138,887 B2 9/2015 Su
9,333,631 B2 5/2016 Su
2004/0126182 A1 * 7/2004 Lin ..... B25B 23/0021 403/322.2
2005/0145078 A1 * 7/2005 Chuan ..... B25B 23/0035 81/177.85
2007/0163406 A1 * 7/2007 Liu ..... B25B 23/0035 81/177.85

* cited by examiner

*Primary Examiner* — Robert J Scruggs
(74) *Attorney, Agent, or Firm* — Alan D. Kamrath; Mayer & Williams PC

(57) ABSTRACT

A high strength drive extension includes a shaft, a sleeve, and a detent. The shaft includes a connecting structure. The sleeve is movably coupled to the shaft. The sleeve includes a driving head. The sleeve defines a hole in which the shaft inserts. The hole defines a receiving region mating with the connecting structure. The detent is configured to releasably retaining a tool on the driving head. The sleeve is disposed between the shaft and the sleeve and is movable between locking and unlocking positions in response to relative movement of the sleeve and the shaft.

12 Claims, 4 Drawing Sheets

HIGH STRENGTH DRIVE EXTENSION

BACKGROUND OF THE INVENTION

1. Field of the Invention

The present invention relates to a drive extension and, particularly, to a high strength drive extension.

2. Description of the Related Art

Refer to Taiwan Pat. No. 1426008, a drive extension is adapted to couple to a pneumatic driving tool and includes a shaft, a spring mounted on the shaft, and a sleeve mounted on the shaft being urged by the spring, and being movable to control a detent mechanism. When an object is coupled to the drive extension, the object engages with the sleeve, and the detent mechanism is in a position releasably retaining the object.

Furthermore, the sleeve has a quadrilateral receptacle, and the shaft has a corresponding quadrilateral body engaged in the quadrilateral receptacle. Therefore, the sleeve is rotatable with the drive extension.

When the pneumatic tool rapidly turns the drive extension, the sleeve and the shaft PEI are subject to a large torque transmission. Unfortunately, the sleeve and the shaft do not have sufficient strength to prevent deformation.

The present invention is, therefore, intended to obviate or at least alleviate the problems encountered in the prior art.

SUMMARY OF THE INVENTION

According to the present invention, a high strength drive extension includes a shaft, a sleeve, and a detent.

The shaft has a first end and a second end, extends longitudinally from the first end to the second end along an axis, and includes a first connecting structure and a second connecting structure at the second end. The shaft has a width in a width direction radial to the axis. A maximum width of the first connecting structure is smaller than a minimum width of the second connecting structure. The second connecting structure has a first width.

The sleeve has a first end and a second end opposite the first end and extends longitudinally from the first end to the second end. The sleeve is movably coupled to the shaft. The sleeve includes a driving head at the first end. The sleeve defines a hole in which the shaft inserts. The sleeve is movable on the shaft along the axis. The hole defines first and second receiving regions respectively mating with the first and second connecting structures. The hole has a width direction radial to the axis. A maximum width of the first receiving region is smaller than a minimum width of the second receiving region. The driving head of the sleeve has a second width. The first width is greater than the second width.

The detent for releasably retaining a tool on the driving head is disposed between the shaft and the sleeve and is movable between locking and unlocking positions in response to relative movement of the sleeve and the shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
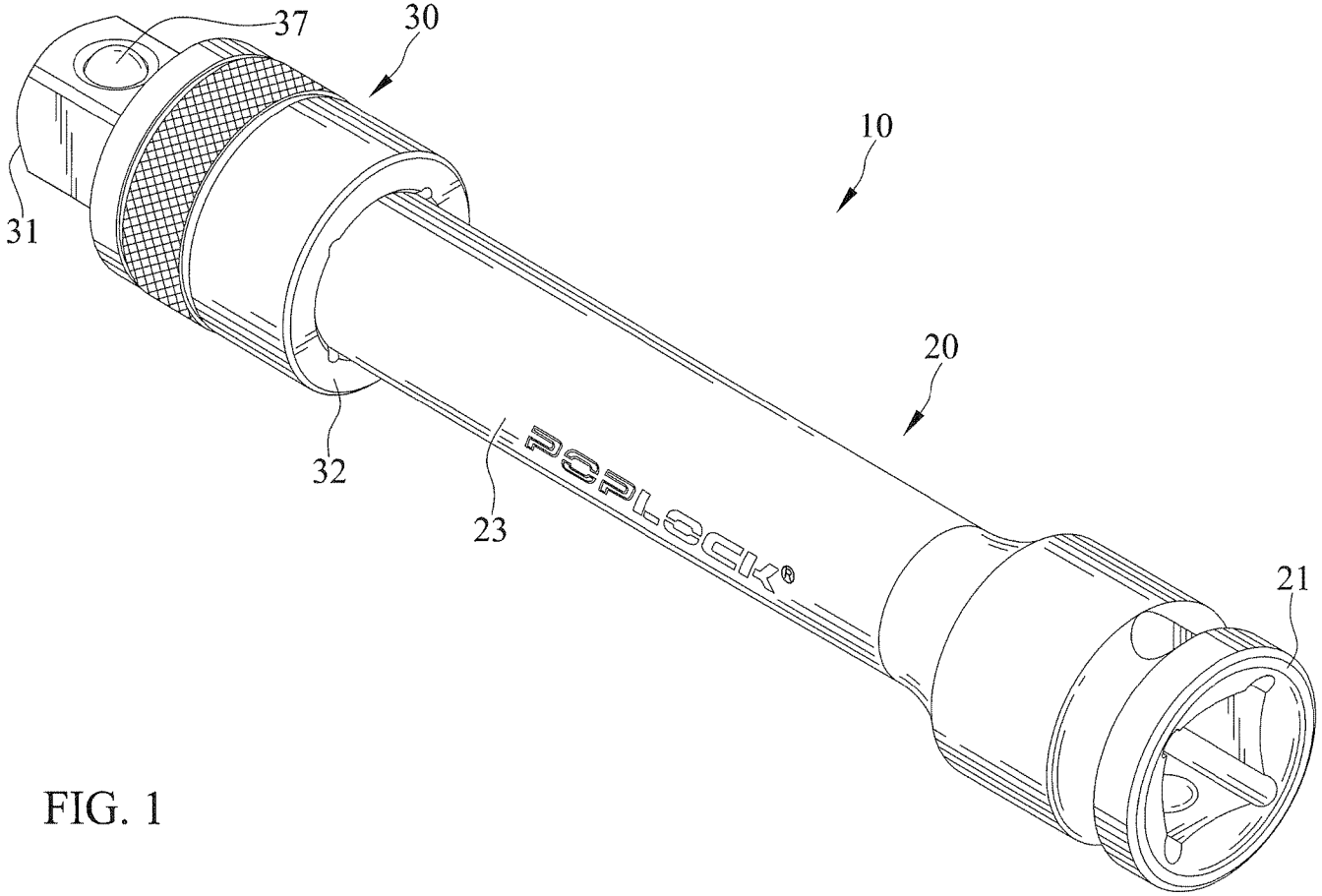
FIG. 1 is a perspective view of a high strength drive extension in accordance with the present invention.
Figure 2:
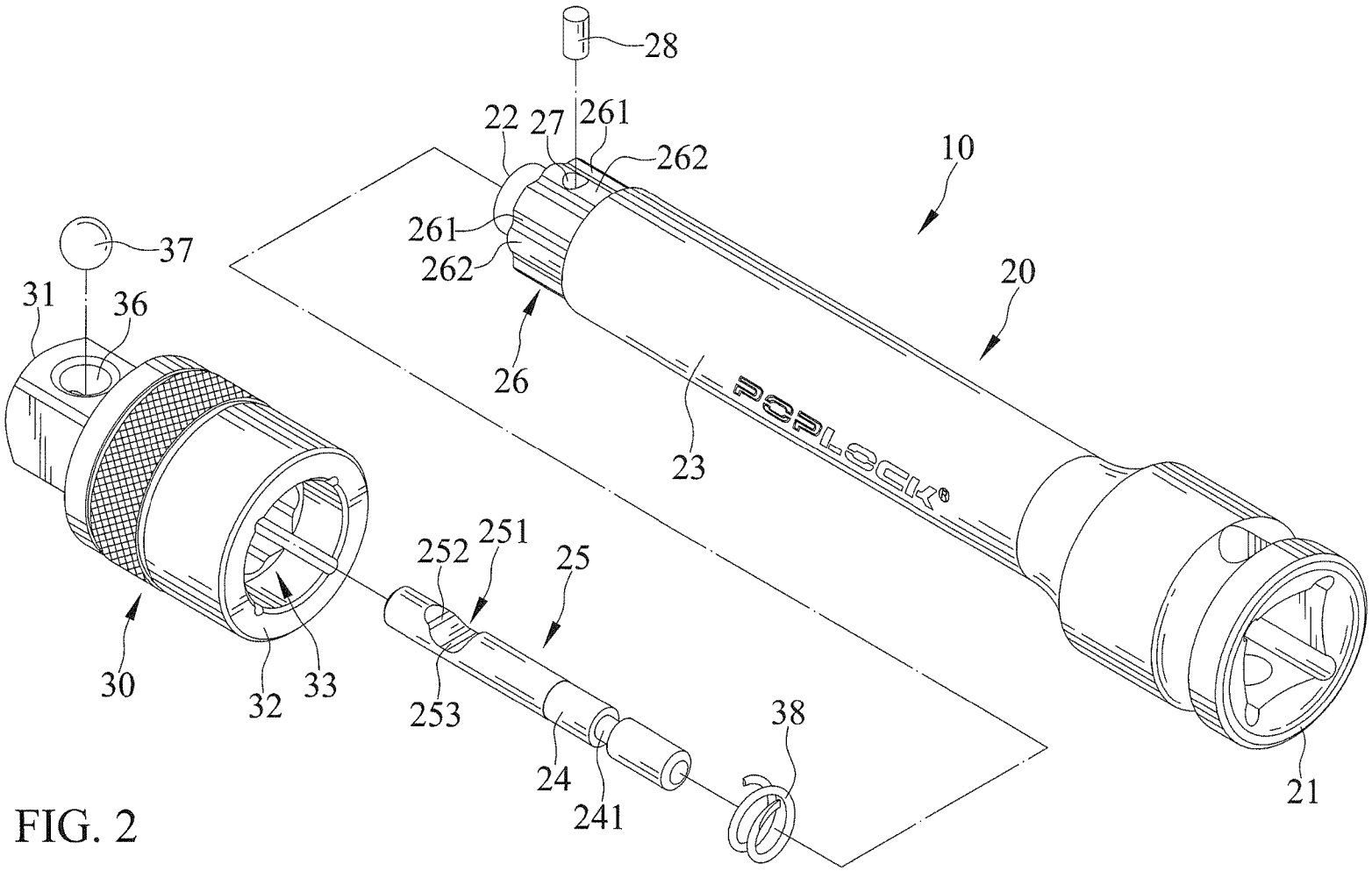
FIG. 2 is an exploded perspective view of the high strength drive extension.
Figure 3:
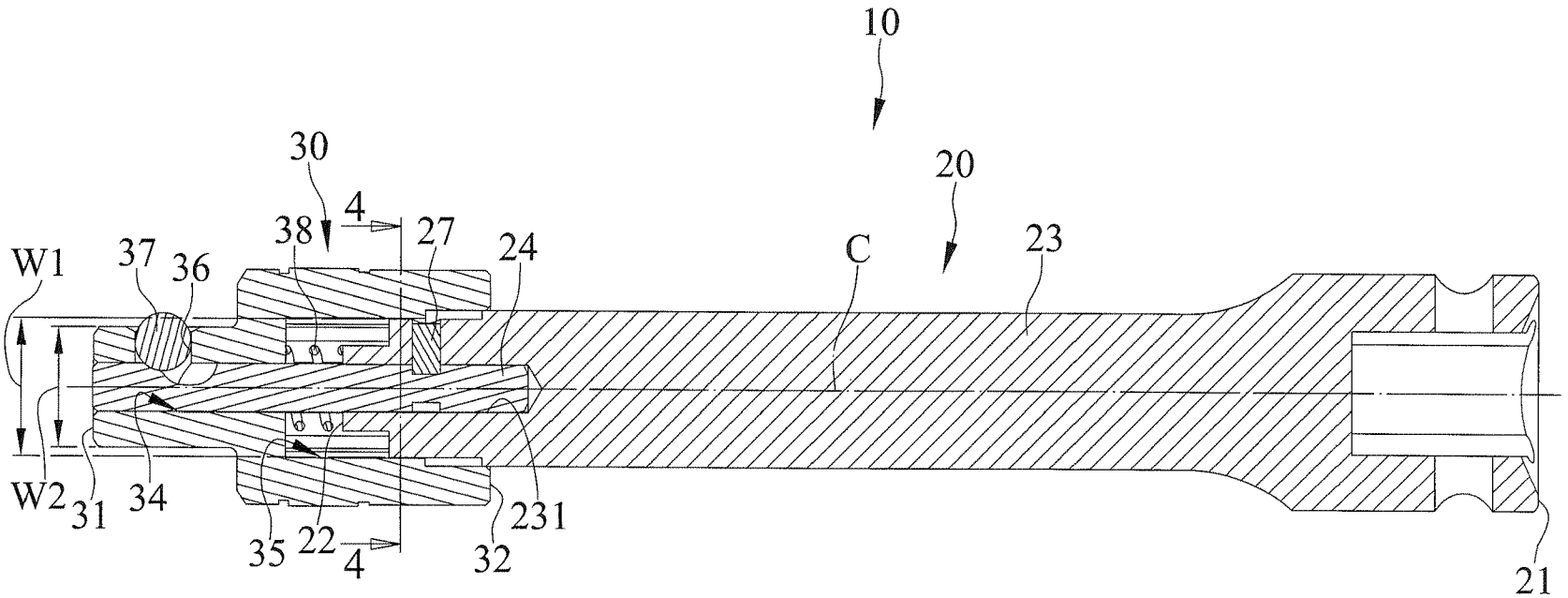
FIG. 3 is a cross-sectional view of the high strength drive extension.
Figure 4:
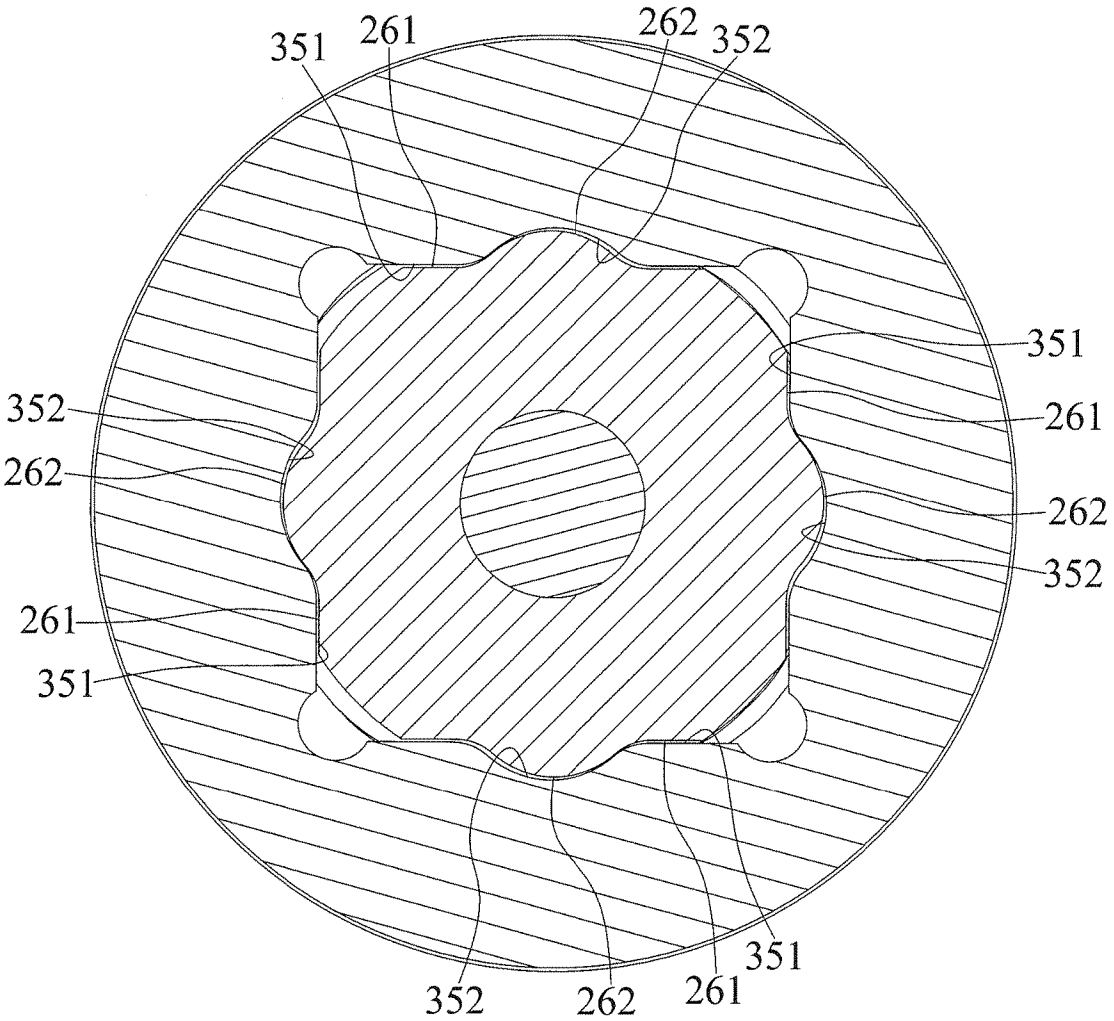
FIG. 4 is a cross-sectional view taken along line 4-4 of FIG. 3.

FIGS. 1 through 4 show a drive extension 10 in accordance with the present invention. The drive extension 10 includes a shaft 20, a sleeve 30, and a detent 37.

The shaft 20 has a first end 21 and a second end 22 and extends longitudinally from the first end 21 to the second end 22 along an axis C. The first end 21 of the shaft 20 defines a cavity for coupling with a driving tool. The driving tool can drive, i.e. rotate, the drive extension 10. The shaft 20 includes a first connecting structure 25 and a second connecting structure 26 at the second end 22.

The first connecting structure 25 defines a recessed area 251 with a first recessed portion 252 and a second recessed portion 253. The second recessed portion 253 is deeper than the first recessed portion 252 such that a radial distance from the axis C to a bottom of the second recessed portion 253 is smaller than a radial distance from the axis C to a bottom of the first recessed portion 252.

The first connecting structure 25 has a circular cross section. The second connecting structure 26 has at least three flat first driving sides 261. The second connecting structure 26 has four flat first driving sides 261 illustrated in FIG. 4.

Each first driving side 261 extends lengthwise along the axis C. Each first driving side 261 defines a protrusion 262 protruding therefrom. The protrusion 262 extends radially outwardly from the respective first driving side 261. The protrusion 262 has a curved cross section. The protrusion 262 extends lengthwise along the axis C. The protrusion 262 has a length not greater a length of the respective first driving side 261.

The shaft 20 has a width direction radial to the axis C. A maximum width of the first connecting structure 25 is smaller than a minimum width of the second connecting structure 26. The second connecting structure 26 has a first width W1.

The shaft 20 includes a first shaft segment 23 and a second shaft segment 24 extending axially outwardly from the first shaft segment 23. The first and second shaft segments 23 and 24 are aligned along the axis C. The first and second connecting structures 25 and 26 are respectively located on the second and first shaft segments 24 and 23. The first shaft segment 23 defines a first orifice 231 extending lengthwise along the axis C and including an opening at an end of the first shaft segment 23. The second shaft segment 24 includes a first end fit in the first orifice 231 and a second end opposite the first end disposed outside the first orifice 231. The first shaft segment 23 defines a second orifice 27 and the second shaft segment 24 defines a groove 241 communicating with the second orifice 27. The second orifice 27 extends radially with respect to the axis C. The second orifice 27 is located on the second connecting structure 26. The second orifice 27 is located between the two protrusions 262 of the two adjacent first driving sides 261. The groove 241 includes two opposite sides spaced along the axis C. The first and second shaft segments 23 and 24 include a restrainer 28 engaging therewith. The restrainer 28 is inserted in the second orifice 27 and restrained between the opposite sides of the groove 241. The restrainer 28 restrains relative movement of the first and second shaft segments 23 and 24. The restrainer 28 is a one-piece structure.

The sleeve 30 has a first end 31 and a second end 32 opposite the first end 31 and extends longitudinally from the first end 31 to the second end 32. The sleeve 30 includes a driving head at the first end 31. The sleeve 30 is movably coupled to the shaft 20. The sleeve 30 defines a hole 33 in which the shaft 20 inserts. The hole 33 extends through the first and second ends 31 and 32 of the sleeve 30. The sleeve 30 is movable on the shaft 20 along the axis C. The hole 33 defines first and second receiving regions 34 and 35 respectively mating with the first and second connecting structures 25 and 26. The first receiving region 34 has a circular cross section.

The hole 33 has a width in a width direction radial to the axis C. A maximum width of the first receiving region 34 is smaller than a minimum width of the second receiving region 35. The second receiving region 35 has at least three flat second driving sides 351 mutually engaging with the three first driving sides 261. The second receiving region 35 has four flat second driving sides 351 illustrated in FIG. 4. Each second driving side 351 extends lengthwise along the axis C. Each second driving side 351 defines a recess 352 receiving the protrusion 262 of the respective first driving side 261. The recess 352 extends inwardly into the respective second driving side 351. The recess 352 has a curved cross section. The recess 352 extends lengthwise along the axis C. The recess 352 has a length not greater than a length of the respective second driving side 351. The sleeve 30 is urged by a resilient member 38. Moreover, the sleeve 30 defines an aperture 36 extending radially with respect to the axis C.

The resilient member 38 is retained between the shaft 20 and the sleeve 30. The resilient member 38 is carried by the first connecting structure 25 and is received by the hole 33. The first end of the resilient member 38 abuts an interface between the first and second receiving regions 34 and 35. The second end of the resilient member 38 abuts the shaft 20.

The detent 37 is configured to releasably retaining a tool on the driving head. The detent 37 is disposed between the shaft 20 and the sleeve 30 and is movable between locking and unlocking positions in response to relative movement of the sleeve 30 and the shaft 20. The detent 37 is movably retained in the aperture 36 and is received by the recessed area 251. The sleeve 30 is movable on the shaft 20 between a first position in which the detent 37 is in the locking position, protrudes outside the aperture 36, and is supported by the bottom of the first recessed portion 252 and a second position in which the detent 37 is in the unlocking position, does not protrude outside the aperture 36, and is supported by the bottom of the second recessed portion 253.

The first connecting structure 25 is movable in the first receiving regions 34 in response to relative movement of the sleeve 30 and the shaft 20. Moreover, the first connecting structure 25 is partially received by the second receiving region 35. The second connecting structure 26 is movable in second receiving region 35 in response to relative movement of the sleeve 30 and the shaft 20.

In view of the forgoing, the drive extension 10 has high strength and avoids deformation of parts thereof in that the second connecting structure 26 is wider than the driving head of the sleeve 30. Furthermore, the first driving sides 261 and the second driving sides 351 mutually engage with one another, and the protrusions 262 are respectively received in the recesses 352.

The foregoing is merely illustrative of the principles of this invention and various modifications can be made by those skilled in the art without departing from the scope and spirit of the invention.

What is claimed is:

1. A high strength drive extension comprising:

a shaft having a first end and a second end and extending longitudinally from the first end to the second end along an axis, with the shaft including a first connecting structure and a second connecting structure at the second end, wherein the shaft has a width in a width direction radial to the axis, wherein a maximum width of the first connecting structure is smaller than a minimum width of the second connecting structure, wherein the second connecting structure has a first width;

a sleeve having a first end and a second end opposite the first end, extending longitudinally from the first end to the second end, and movably coupled to the shaft, wherein the sleeve includes a driving head at the first end, wherein the sleeve defines a hole in which the shaft inserts, wherein the sleeve is movable on the shaft along the axis, wherein the hole defines first and second receiving regions respectively mating with the first and second connecting structures, wherein the hole has a width in a width direction radial to the axis, wherein a maximum width of the first receiving region is smaller than a minimum width of the second receiving region, wherein the driving head of the sleeve has a second width, and wherein the first width is greater than the second width; and a detent for releasably retaining a tool on the driving head disposed between the shaft and the sleeve and being movable between locking and unlocking positions in response to relative movement of the sleeve and the shaft;

wherein the second connecting structure has at least three flat first driving sides, wherein each first driving side defines a protrusion protruding therefrom, with the protrusion unmovably protruding from each first driving side, wherein the second receiving region has at least three flat second driving sides mutually engaging with the at least three first driving sides, and wherein each second driving side defines a recess receiving the protrusion of the first driving side engaged therewith.

2. The high strength drive extension as claimed in claim 1, wherein the protrusion extends radially outwardly from each first driving side, wherein the protrusion has a curved cross section, wherein the recess extending inwardly into each second driving side, and wherein the recess has a curved cross section.

3. The high strength drive extension as claimed in claim 1, wherein each first driving side extends lengthwise along the axis, wherein the protrusion extends lengthwise along the axis, wherein each second driving side extends lengthwise along the axis, and wherein the recess extends lengthwise along the axis.

4. The high strength drive extension as claimed in claim 3, wherein the protrusion has a length not greater than a length of each first driving side, and wherein the recess has a length not greater than a length of each second driving side.

5. The high strength drive extension as claimed in claim 1, wherein the first connecting structure defines a recessed area with a first recessed portion and a second recessed portion, wherein the second recessed portion is deeper than the first recessed portion such that a radial distance from the axis to a bottom of the second recessed portion is smaller than a radial distance from the axis to a bottom of the first recessed portion, wherein the sleeve defines an aperture extending radially with respect to the axis on the driving head, wherein the detent is movably retained in the aperture and is received by the recessed area, and wherein the sleeve is movable on the shaft between a first position in which the detent is in the locking position, protrudes outside the aperture, and is supported by the bottom of the first recessed portion and a second position in which the detent is in the unlocking position, does not protrude outside the aperture, and is supported by the bottom of the second recessed portion.

6. The high strength drive extension as claimed in claim 5, wherein the sleeve is urged by a resilient member, wherein the resilient member is retained between the shaft and the sleeve, and wherein the resilient member is carried by the first connecting structure and is received by the hole.

7. The high strength drive extension as claimed in claim 6, wherein the first connecting structure has a circular cross section, and wherein the first receiving region has a circular cross section.

8. The high strength drive extension as claimed in claim 1, wherein the shaft includes a first shaft segment and a second shaft segment extending axially outwardly from the first shaft segment, wherein the first and second shaft segments are aligned along the axis, and wherein the first and second connecting structures are respectively located on the second and first shaft segments.

9. The high strength drive extension as claimed in claim 8, wherein the first shaft segment defines a first orifice extending lengthwise along the axis and including an opening at an end of the first shaft segment, and wherein the second shaft segment includes a first end fit in the first orifice and a second end opposite the first end disposed outside the first orifice.

10. The high strength drive extension as claimed in claim 9, wherein the first shaft segment defines a second orifice and the second shaft segment defines a groove communicating with the second orifice, wherein the second orifice extends radially with respect to the axis, wherein the groove includes two opposite sides spaced along the axis, wherein the first and second shaft segments include a restrainer engaging therewith, and wherein the restrainer is inserted in the second orifice and restrained between the two opposite sides of the groove.

11. The high strength drive extension as claimed in claim 8, wherein the first connecting structure defines a recessed area with a first recessed portion and a second recessed portion, wherein the second recessed portion is deeper than the first recessed portion such that a radial distance from the axis to a bottom of the second recessed portion is smaller than a radial distance from the axis to a bottom of the first recessed portion, wherein the sleeve defines an aperture extending radially with respect to the axis on the driving head, wherein the detent is movably retained in the aperture and is received by the recessed area, and wherein the sleeve is movable on the shaft between a first position in which the detent is in the locking position, protrudes outside the aperture, and is supported by the bottom of the first recessed portion and a second position in which the detent is in the unlocking position, does not protrude outside the aperture, and is supported by the bottom of the second recessed portion.

12. The high strength drive extension as claimed in claim 11, wherein the sleeve is urged by a resilient member, wherein the resilient member is retained between the shaft and the sleeve, and wherein the resilient member is carried by the first connecting structure and is received by the hole.

* * * * *